United States Patent [19]

Poush et al.

[11] 4,085,027

[45] Apr. 18, 1978

[54] HYBRID BIPOLAR ELECTRODE

[75] Inventors: Kenneth A. Poush, Lake Jackson, Tex.; James E. Reynolds, Golden, Colo.

[73] Assignee: Kerr-McGee Chemical Corporation, Oklahoma City, Okla.

[21] Appl. No.: 545,016

[22] Filed: Jan. 29, 1975

[51] Int. Cl.[2] ..... C25B 9/00; C25B 11/00; C25B 13/00; C25B 1/34

[52] U.S. Cl. ..... 204/268; 204/254; 204/286

[58] Field of Search ..... 204/286, 268, 254, 255, 204/256

[56] References Cited

U.S. PATENT DOCUMENTS

| | | | |
|---|---|---|---|
| 806,413 | 12/1905 | Kother | 204/268 |
| 3,242,065 | 3/1966 | Nora et al. | 204/255 |
| 3,312,614 | 4/1967 | Schick | 204/255 |
| 3,389,071 | 6/1968 | Meyers | 204/268 |
| 3,402,117 | 9/1968 | Evans | 204/286 |
| 3,752,757 | 8/1973 | Stephenson et al. | 204/256 |
| 3,759,813 | 9/1973 | Raetzsch et al. | 204/256 |
| 3,813,326 | 5/1974 | Gunby | 204/268 |
| 3,824,173 | 7/1974 | Bouy et al. | 204/284 |
| 3,859,197 | 1/1975 | Bouy et al. | 204/284 |
| 3,873,437 | 3/1975 | Pulver | 204/254 |
| 3,884,792 | 5/1975 | McGilvery | 204/268 |
| 3,910,827 | 10/1975 | Raetzsch et al. | 204/98 |

*Primary Examiner*—F.C. Edmundson
*Attorney, Agent, or Firm*—William G. Addison

[57] ABSTRACT

An improved hybrid bipolar electrode particularly useful in an alkali chloride electrolysis application, having an anodic member and cathodic member connected in spaced apart relationship by a fastener assembly, a seal being formed between portions of the anodic member and the cathodic member to substantially seal electrolyte from the space between the anodic member and the cathodic member. In one aspect, a barrier member is interposed between the anodic member and the cathodic member to inhibit the contact of migrating atomic hydrogen with the anodic member. In one other aspect of the present invention, a portion of the fastener assembly is constructed of an electrically conductive material and electrical continuity is established between the anodic member and the cathodic member via the fastener assembly, the barrier member serving to effectuate a more even distribution of current flow between the cathodic member and the anodic member in yet another aspect of the present invention.

14 Claims, 6 Drawing Figures

HYBRID BIPOLAR ELECTRODE

CROSS-REFERENCE TO RELATED APPLICATIONS

Related subject matter is disclosed in the patent application, Ser. No. 545,015, entitled "A BIPOLAR ELECTRODE AND METHOD FOR CONSTRUCTING SAME," filed on an even date with the present application and assigned to the assignee of the present invention.

BACKGROUND OF THE INVENTION

1. Field of the Invention

The present invention relates generally to an improved bipolar electrode and, more particularly, but not by way of limitation, to an improved hybrid bipolar electrode having an anodic member and a cathodic member connected in a spaced apart relationship.

2. Brief Description of the Prior Art

In the past, many electrolytic cells have been proposed for use in a variety of applications. Various electrodes for use in electrolytic cell applications have also been proposed in the past.

A typical prior art electrolytic cell included an anode electrode and a cathode electrode immersed in an electrolyte and an electrical power source connected to the anode electrode and the cathode electrode, the positive side of the power source being connected to the anode electrode and the negative side of the power source being connected to the cathode electrode. In this type of electrolytic cell, the electrode functioning as the anode and the electrode functioning as the cathode were generally referred to in the art as "monopolar" electrodes, i.e. each electrode functions as either an anode or a cathode during electrolysis.

Another type of electrolytic cell included an anode electrode and a cathode electrode and at least one electrode interposed between the anode and the cathode electrodes, each of the electrodes interposed between the anode and the cathode electrodes having an anodic member and a cathodic member and being referred to in the art as "bipolar" electrodes. The cathodic member and the anodic member of each bipolar electrode were mechanically connected, and the cathodic member of each of the bipolar electrodes was electrically in series with the anodic members prior and subsequent thereto, i.e. the current flowed through the electrolyte to the cathodic member of the bipolar electrode, through the bipolar electrode and from the anodic member of the bipolar electrode through the electrolyte to the next cathodic member of another bipolar electrode or to the cathodic member of the monopolar cathode electrode depending on the number of bipolar electrodes in the electrolytic cell.

In the past, electrodes constructed of a carbon material have been used in the construction of both monopolar electrodes and bipolar electrodes. In some instances, the anodic surfaces were constructed of a carbon material and the cathodic surfaces were constructed of a ferrous material, this type of construction tending to minimize contamination of the electrolyte which results from the electrolytic erosion of many non-carbon anodes.

Bipolar electrodes have been constructed of graphite and, in these instances, the graphite was continuously consumed during electrolysis as a result of oxidation of the graphite surfaces. As the graphite bipolar electrode was consumed, the voltage drop across the electrolytic cell was increased and the temperature of the electrolyte increased with the result being the establishment of an operating temperature range of approximately 25° C to approximately 70° C. At the upper limit of this operating temperature range, the loss of graphite as a result of graphite oxidation was substantially increased and, in some instances, cooling coils were included in the electrolytic cell to cool the electrolyte in an attempt to maintain the electrolyte temperature at a reduced level (approximately 50° C, for example).

The erosion of the carbon bipolar electrodes caused dimensional instability and resulted in a decreased current efficiency as the carbon bipolar electrode was operated over a period of time. Since the erosion of the carbon bipolar electrodes was not uniform, current density gradients were formed which caused further deleterious effects on the operational characteristics of the electrolytic cell.

In recent years, metal electrodes have been proposed to be operated as anodes in bipolar electrolytic cells, such bipolar electrodes also including a cathodic surface. For example, anodic surfaces of titanium have been proposed with cathodic surfaces bonded thereto and such bipolar electrodes have been proposed for use in chloride brines. A non-conductive film tends to form on exposed titanium anodic surfaces in chloride brines; however, this non-conductive film does not tend to develop on precious metals, such as platinum, for example, and platinum in combination with iridium or rubidium coated titanium anodic surfaces have been utilized in chlor-alkali electrolytic cell applications.

In the past, metal bipolar electrodes have been constructed of titanium sheets bonded to steel plates, the titanium sheets forming the anodic member and the steel plate forming the cathodic member. One problem encountered with such bi-metal bipolar electrodes was that the titanium sheet was deformed via the action of molecular hydrogen migrating through the cathodic member to the anodic member forming an expanded hydride with the titanium. This action resulted in a weakening of the structural integrity of the bond between the titanium sheet and the steel plate and, in many instances, resulted in a separation of the titanium-steel along the bonded surface.

Typical patents disclosing prior art devices of the type generally referred to above are the U.S. Pat. Nos. 3,759,813, issued to Raetzsch, et al; 3,732,157, issued to Dewitt; 3,043,757, issued to Holmes; 3,441,495, issued to Colman; and 3,222,270, issued to Edwards.

SUMMARY OF THE INVENTION

The present invention contemplates an improved bipolar electrode and methods for constructing same and electrolytic cells containing the same. The bipolar electrode includes an anodic member and a cathodic member secured in a spaced apart relationship via at least one fastener assembly. The anodic member and the cathodic member are electrically connected for conducting current therebetween, and the space between the anodic member and the cathodic member is sealed to substantially inhibit the flow of electrolyte into such space during the operation of the hybrid bipolar electrode in an electrolytic cell. In one form, the bipolar electrode of the present invention includes a barrier member interposed in the space between the anodic member and the cathodic member and constructed of a material inhibiting the contact of hydrogen with the anodic member in an electrolysis application.

DESCRIPTION OF THE PREFERRED EMBODIMENTS

Figure 1:
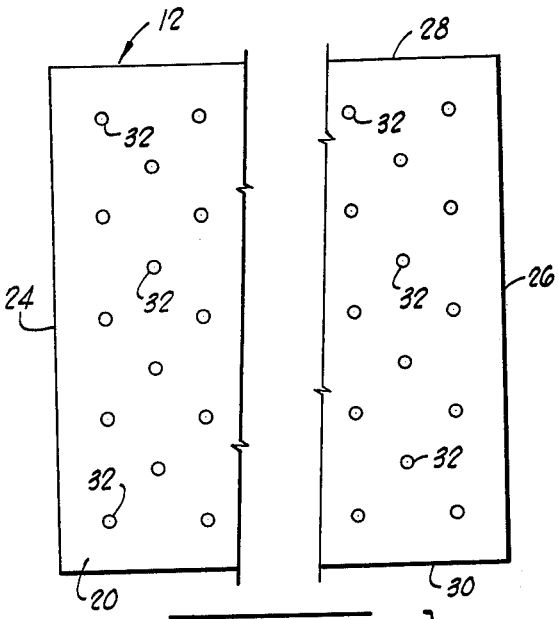
FIG. 1 is an elevational view of the first face of an anodic member of a hybrid bipolar electrode constructed in accordance with the present invention.

Referring to the drawings and to FIGS. 1 through 4 in particular, shown therein and designated via the general reference numeral 10 is a hybrid bipolar electrode constructed in accordance with the present invention. In general, the hybrid bipolar electrode includes an anodic member 12, a cathodic member 14, a plurality of fastener assemblies 16 connecting the anodic member 12 and the cathodic member 14 in a spaced apart relationship (only some of the fastener assemblies being specifically shown in FIGS. 3 and 4, for clarity), and a barrier member 18 disposed in the space between the anodic member 12 and the cathodic member 14, the fastener assemblies 16 also securing the barrier member 18 in an assembled position supported between the anodic member 12 and the cathodic member 14.

The anodic member 12 is generally rectangularly shaped and has a first face 20, a second face 22, a first side 24, a second side 26, a third side 28 and a fourth side 30. A plurality of openings 32 are formed through the anodic member 12 and each opening 32 extends through the anodic member 12 intersecting the first face 20 and the second face 22 thereof (only some of the openings 32 are specifically designated via a reference numeral in the drawings for clarity). More particularly, each of the openings 32 is sized and shaped to accommodate a portion of one of the fastener assemblies 16, and, in one preferred form, the openings 32 are spaced on the anodic member 12 in accordance with a predetermined spacing pattern arranged for cooperation with the fastener assemblies 16 in a manner to be described below.

The anodic member 12 is constructed such that the first face 20 of the anodic member 12 operates as an anodic surface in an electrolytic cell. In one preferred embodiment, the hybrid bipolar electrode 10 is utilized in an alkali metal chlorate or chlorine electrolytic cell for the electrolysis of aqueous solutions of alkali metal chlorides and, in this one preferred embodiment, the anodic member 12 is constructed of a titanium metal sheet having a coating of a noble metal or oxide thereof on the first face 20, such as platinum-iridium, platinum, rubidium, ruthenium, osmium and oxides thereof and the like, for example, the coating being electrically conductive and forming the anodic surface on the anodic member 12 (the coating forming the anodic surface not being separately illustrated in the drawings).

The cathodic member 14 is generally rectangularly shaped and has a first face 34, a second face 36, a first side 38, a second side 40, a third side 42 and fourth side 44. The cathodic member 14 is constructed such that the first face 34 of the cathodic member 14 operates as a cathodic surface in an electrolytic cell. In one preferred embodiment, the hybrid bipolar electrode 10 is utilized in an alkali metal chlorate or chlorine electrolyte cell for the electrolysis of aqueous solutions of alkali metal chlorides in a manner mentioned before with respect to the anodic member 12 and, in this one preferred embodiment, the cathodic member 14 is constructed of a carbon steel, stainless steel, or other ferrous materials or non-ferrous materials such as copper, nickel or molybdenum, for example, serviceable in chlorate solutions.

Figure 3:
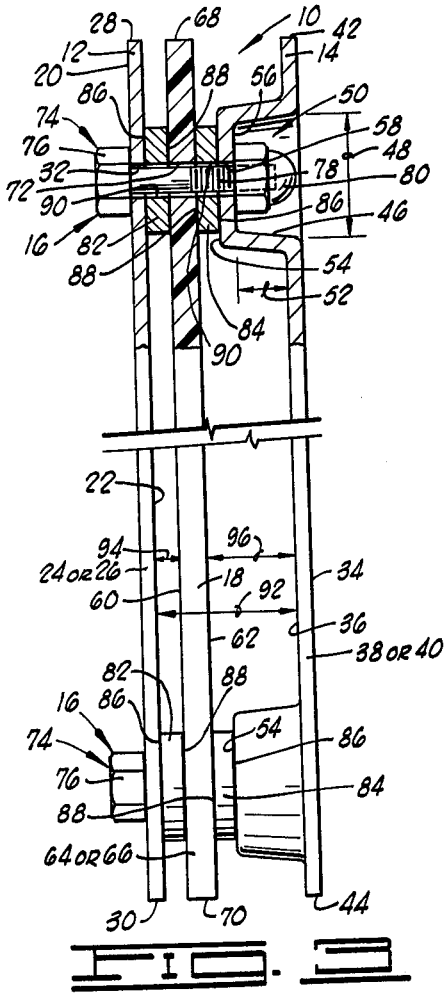
FIG. 3 is a fragmentary, partial sectional, partial elevational view showing a typical first or second side elevational view of the anodic member of FIG. 1 connected via a fastener assembly to the cathodic member of FIG. 2 forming the hybrid bipolar electrode of the present invention, only two typical fastener assemblies being shown in FIG. 3.

A plurality of generally cylindrically shaped depressions 46 are formed in the first face 34 of the cathodic member 14. Each of the depressions 46 has an internal diameter 48, as shown in FIG. 3, and forms an open space 50 extending a distance 52 generally into the first face 34 of the cathodic member 14 terminating with an end wall 56 (only some of the depressions 46 are specifically designated in the drawings via a reference numeral for clarity). Each of the depressions 46 forms a corresponding raised portion on the second face 36 of the cathodic member and each raised portion extends a distance generally from the second face 36 terminating with an end 54.

A plurality of openings 58 are formed through the cathodic member 14, each opening 58 extending through the cathodic member 14 intersecting the first face 34 and the second face 36 thereof. More particularly, each of the openings 58 is formed through a central portion of one of the depressions 46, each opening 58 intersecting the end wall 56 and the end 54 formed via one of the depressions 46. The depressions 46 and, more particularly, the openings 58 are spaced in accordance with a predetermined spacing pattern substantially corresponding with the spacing pattern of the openings 32 in the anodic member 12 and, in an assembled position of the bipolar electrode 10, each of the openings 58 in the cathodic member 14 is substantially aligned with one of the openings 32 in the anodic member 12.

The barrier member 18 is generally rectangularly shaped and has a first face 60, a second face 62, a first side 64, a second side 66, a third side 68 and a fourth side 70. A plurality of openings 72 are formed through the barrier member 18 and each opening 72 extends through the barrier member 18 intersecting the first face 60 and the second face 62 thereof (only one of the openings 72 being shown in the drawings). The openings 72 are spaced in accordance with a predetermined spacing pattern corresponding with the spacing pattern of the openings 32 in the anodic member 12 and corresponding with the spacing pattern of the openings 58 in the cathodic member 14. In an assembled position of the bipolar electrode 10, each of the openings 72 in the barrier member 18 is substantially aligned with one of the openings 32 in the anodic member 12, each of the openings 72 in the barrier member 18 also being substantially aligned with one of the openings 58 in the cathodic member 14.

Figure 4:
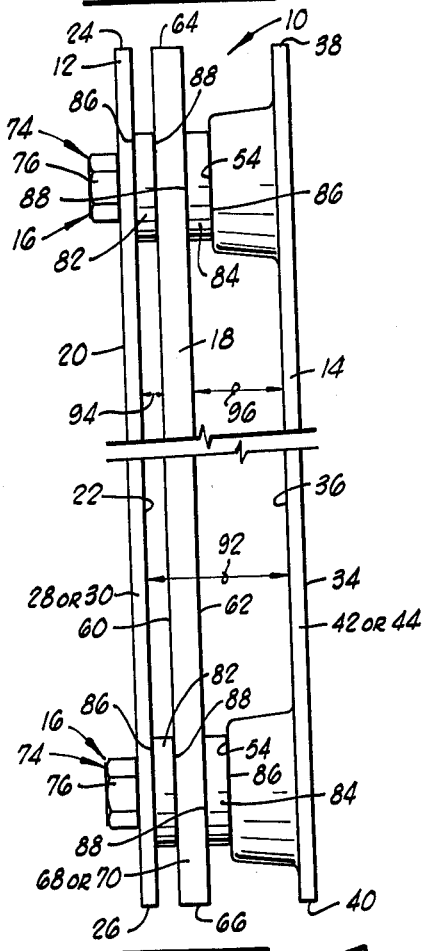
FIG. 4 is a fragmentary elevational view similar to FIG. 3, but showing a typical third or fourth side elevational view of the hybrid bipolar electrode of the present invention, only two of the fastener assemblies being shown in FIG. 4.

Each fastener assembly 16 includes a bolt member 72 having a head portion 76 and a threaded rod portion 78, only one of the fastener assemblies 16 being shown in FIGS. 3 and 4 for clarity. In a fastened position of the fastener assemblies 16, the rod member 78 of each bolt member 74 extends through one of the aligned openings 32 of the anodic member 12, through one of the aligned openings 72 of the barrier member 18, and through one of the aligned openings 58 of the cathode member 14. Each of the fastener assemblies 16 also includes a nut member 80 having a threaded opening (not shown) extending a distance therethrough and sized to threadedly engage the threaded rod portion 78 of one of the bolt members 74, each nut member 80 being generally disposed in one of the open spaces 50 formed in the depressions 46, in a fastened position of the fastener assemblies 16.

In one preferred embodiment, as shown in FIGS. 3 and 4, each fastener assembly 16 includes a first and a second spacer 82 and 84, respectively. The spacers 82 and 84 are similarly constructed and each spacer 82 and 84 has opposite end faces 86 and 88 and an opening 90 extending through a central portion thereof intersecting the end faces 86 and 88. The first spacer 82 of each fastener assembly 16 is disposed between the anodic member 12 and the barrier member 18 and the rod portion 78 of each of the bolt members 74 extends through the opening 80 formed through one of the first spacers 82, the bolt members 74 supporting the first spacers 82 in an assembled position between the anodic member 12 and the barrier member 18. The second spacer 84 of each fastener assembly 16 is disposed between the cathodic member 14 and the barrier member 18 and the rod portion 78 of each of the bolt members 74 extends through the opening 90 formed through one of the second spacers 84, the bolt members 74 supporting the second spacers 84 in an assembled position between the cathodic member 14 and the barrier member 18.

Figure 2:
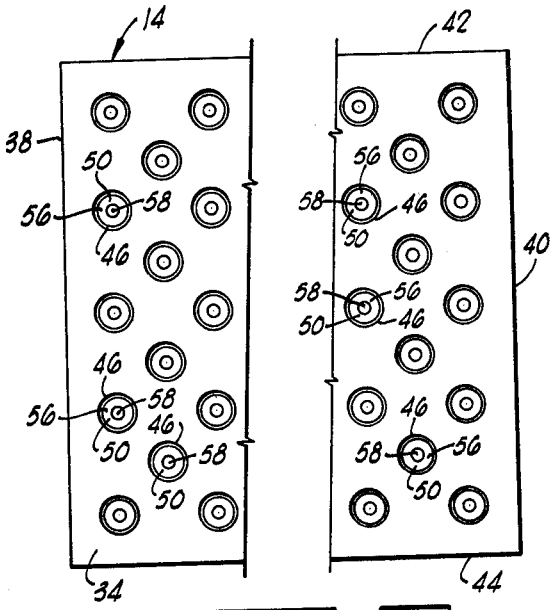
FIG. 2 is an elevational view of the first face of a cathodic member of the hybrid bipolar electrode of the present invention.

To assemble the hybrid bipolar electrode 10, the rod portions 78 of the bolt members 74 are inserted through the openings 32 in the anodic member 14 and each of the first spacers 82 are disposed on the rod portion 78 of one of the bolt members 74 with the rod portion 78 extending through the opening 90 in the first spacer 82, the end face 86 of each of the first spacers 82 generally facing the second face 22 of the anodic member 12. The barrier member 18 is disposed near the anodic member 12 and positioned such that each of the openings 58 in the barrier member 18 is aligned with one of the openings 32 in the anodic member 12, the first face 60 of the barrier member 18 generally facing the second face 22 of the anodic member 12. The barrier member 18 is positioned such that the rod portions 78 of each of the bolt members 74 extends through one of the openings 72 in the barrier member 18 and each of the second spacers 84 is disposed on the rod portion 78 of one of the bolt members 74 with the rod portion 78 extending through the opening 90 in the second spacer 84, the end face 86 of each of the second spacers 84 generally facing the second face 62 of the barrier member 18. The cathodic member 14 is disposed near the barrier member 18 and positioned such that each of the openings 58 in the cathodic member 14 is aligned with one of the openings 72 in the barrier member 18, the second face 36 of the cathodic member 14 generally facing the second face 62 of the barrier member 18. The cathodic member 14 is positioned such that the rod portions 78 of each of the bolt members 74 extends through one of the openings 58 in the cathodic member 14 and end face 88 of each of the second spacers 84 generally faces the second face 36 of the cathodic member 14, a portion of each rod portion 78 extending a distance beyond the end wall 56 formed by one of the depressions 46 and being disposed generally within one of the open spaces 50 formed in the cathodic member 14 via the depressions 46. One of the nut members 80 is threadedly secured to the end portion of each rod portion 78 extending into the open space 50 formed via the depressions 46 and each of the nut members 80 is rotated in one direction threadedly engaging one of the rod portions 78 and securing the hybrid bipolar electrode 10 in an assembled position wherein the anodic member 12, the cathodic member 14 and the barrier member 18 are disposed in generally parallel extending planes in a spaced apart relationship, the ends 86 of each of the first spacers 82 are disposed generally adjacent the second face 22 of the anodic member 12, the ends 88 of each of the first spacers 82 are disposed generally adjacent the first face 60 of the barrier member 18, the ends 86 of each of the second spacers 84 are disposed generally adjacent the second face 62 of the barrier member 18, and the ends 88 of each of the second spacers 84 are disposed generally adjacent the second face 36 of the cathodic member 14. Further, each of the head portions 76 engages a portion of the first face 20 of the anodic member 12, each of the nut members 80 engages a portion of the first face 34 of the cathodic member 14 and the rod portion of each of the bolt members 74 extends through the aligned openings 32, 58 and 72 and through the openings 90 in the spacers 82 and 84. Thus, the fastener assemblies 16 mechanically connect the anodic member 12, the cathodic member 14 and the barrier member 18 in an assembled position with the second face 22 of the anodic member 12 spaced a distance 92 from the second face 36 of the cathodic member 14, and the first spacers 82 of the fastener assemblies 16 cooperate to secure the anodic member 12 in a spaced apart relationship with respect to the barrier member 18 wherein the second face 22 of the anodic member 12 is spaced a distance 94 from the first face 60 of the barrier member 18, the second spacers 84 of the fastener assemblies 16 cooperating to secure the cathodic member 14 in a spaced apart relationship with respect to the barrier member 18 wherein the second face 36 of the cathodic member 14 is spaced a distance 96 from the second face 62 of the barrier member 18. In a preferred form, each nut member 80 is sized and shaped to be disposed in one of the open spaces 50 formed in the cathodic member 14 via the depressions 46 and positioned therein such that the ends of each nut member 80, opposite the ends engaging the end walls 56, are each disposed in a plane disposed generally below and spaced a distance from the planar disposition of the first face 34 of the cathodic member 14. In one preferred embodiment, the bolt member 74 and the nut member 80 of each of the fastener assembies 16 is constructed of a material capable of conducting electrical current or, in other words, an electrical conductor type of material, and, in this one preferred embodiment, a portion of each of the fastener assemblies 16, more particularly, is constructed of an electrical conductor material such as brass or copper, or example. In this embodiment of the present invention, the fastener assemblies 16 establish electrical continuity between the anodic member 12 and the cathodic member 14 in addition to mechanically connecting the anodic member 12 and the cathodic member 14 in the spaced apart relationship. The spacing of the fastener assemblies 16 with respect to the anodic member 12 and the cathodic member 14 is established to provide a uniform current density on the cathodic member 14 and the anodic member 12 during the operation of the hybrid bipolar electrode 10 in additin to the mechanical connecting function of the fastener assemblies 16, the spacing pattern of the fastener assemblies 16 being a repetitive type of pattern as indicated in FIGS. 1 and 2.

Figure 5:
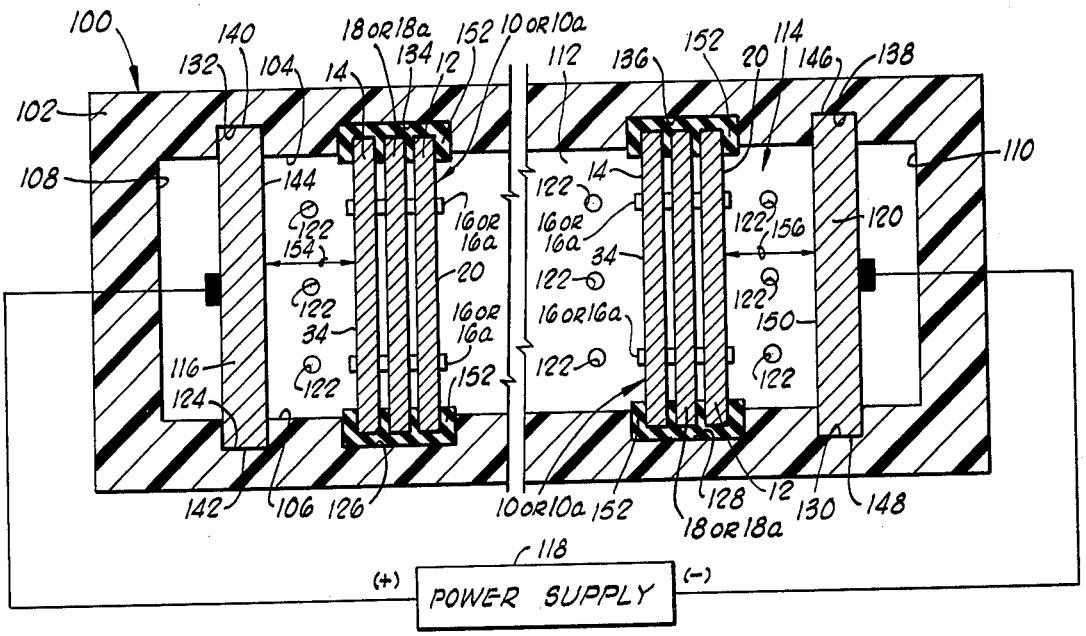
FIG. 5 is a fragmentary partial sectional, partial elevational view showing the hybrid bipolar electrode of the present invention in an electrolytic cell.

As mentioned before, the hybrid bipolar electrodes of the present invention are particularly useful in an alkali metal chlorate or chlorine electrolytic cell for the electrolysis of aqueous solutions of alkali metal chlorides. Diagrammatically and schematically shown in FIG. 5 is an electrolytic cell 100 comprising: a cell box 102 having opposite side walls 104 and 106, opposite end walls 108 and 110 and a base 112 defining a space 114 for retaining the electrolyte; a monopolar anodic electrode 116 connected via conventional means to the positive side of an electrical power source 118 (more particularly, a direct-current power source); a monopolar cathodic electrode 120 connected via conventional means to the negative side of the electrical power source 118; and a plurality of the hybrid bipolar electrodes 10 disposed between the anodic electrode 116 and the cathodic electrode 120 (only the first hybrid bipolar electrode 10 next to the monopolar anodic electrode 116 and the last hybrid bipolar electrode 10 next to the monopolar cathodic electrode 120 being shown in FIG. 5).

In one form, the cell box 102 includes a plurality of openings 122 formed through the base 112 for introducing the electrolyte into the space 114 formed in the cell box 102. A plurality of channels are formed in the side wall 104, only four channels being shown in FIG. 5 and designated therein via the reference numerals 124, 126, 128 and 130, and a plurality of channels are formed in the side wall 106, each of the channels formed in the side wall 106 being aligned with one of the channels 124, 126, 128 and 130 formed in the side wall 104 (only four channels being shown in FIG. 5 and designated therein via the reference numerals 132, 134, 136 and 138).

The monopolar anodic electrode 116 has opposite sides 140 and 142 and a surface 144 operating as an anodic surface during the operation of the electrolytic cell 100. The aligned channels 124 and 132 are sized and positioned to slidingly receive the anodic electrode 116, and the anodic electrode 116 is supported within the space 114 and extends between the side walls 104 and 106, the anodic electrode 116 being at least partially immersed in the electrolyte during the operation of the electrolytic cell 100.

The monopolar cathodic electrode 120 has opposite sides 146 and 148 and a surface 150 operating as a cathodic surface during the operation of the electrolytic cell 100. The aligned channels 130 and 138 are sized and positioned to slidingly receive the cathodic electrode 120, and the cathodic electrode 120 is supported within the space 114 and extends between the side walls 104 and 106, the cathodic electrode 120 being at least partially immersed in the electrolyte during the operation of the electrolytic cell 100.

Assuming the electrolytic cell 100 included only the monopolar electrodes 116 and 120, the electrical power source 118 would be connected to the monopolar electrodes 116 and 120, and the current would flow from the anodic surface 144, through the electrolyte in the space 114, and to the cathodic surface 150. The anodic surface 144 and the cathodic surface 150 are spaced a distance apart and the electrolyte is disposed generally between the anodic surface 144 and the cathodic surface 150. Further, the anodic monopolar electrode 116 is not mechanically connected to the cathodic electrode 120. Assuming further that the electrolytic cell 100 included a plurality of monopolar anodic electrodes and a plurality of monopolar cathodic electrodes, the monopolar anodic electrodes would be connected in parallel to the electrical power source and the monopolar cathodic electrodes would be connected in parallel to the electrical power source. This type of arrangement just described would constitute a typical prior art monopolar electrode type of electrolytic cell configuration.

The present invention is directed to an electrolytic cell which includes at least one bipolar electrode, in contrast to the electrolytic cell which includes only monopolar electrodes described above. Thus, the electrolytic cell 100, shown in FIG. 5, includes the monopolar anodic electrode 116, the monopolar cathodic electrode 120 and one or more of the hybrid bipolar electrodes 10 of the present invention supported within the cell box 102 space 114, generally between the monopolar electrodes 116 and 118, and at least partially immersed in the electrolyte during the operation of the electrolytic cell 100.

The hybrid bipolar electrode 10 includes a seal member 152 (as shown in FIG. 5) extending generally about the sides 24, 26, 28 and 30 of the anodic member 12 and generally about the sides 38, 40, 42 and 44 of the cathodic member 14. A portion of the seal member 152 sealingly engages the cathodic member 14 and a portion of the seal member 152 sealingly engages the anodic member 12 forming a fluid seal between the anodic member 12 and the cathodic member 14 to substantially seal the electrolyte from the space between the second face 22 of the anodic member 12 and the second face 36 of cathodic member 14. Thus, a substantial portion of the space between the second faces 22 and 36 of the anodic and the cathodic members 12 and 14 (depending generally on the size, type and position of the seal member 152, for example) is sealingly isolated from the electrolyte solution during the operation of the electrolytic cell 100. In addition to the seal member 152, each of the openings 32 in the anodic member 12 and each of the openings 58 in the cathodic member 14 are preferably sealed in a manner forming a seal between the fastener assemblies 16 and the portions of the anodic member 12 and the cathodic member 14 generally near the openings 32 and 58. In one form, the engagement between each of the head portions 76 and the first face 20 of the anodic member 12 forms a seal for substantially inhibiting the flow of electrolyte through the openings 32 in the anodic member 12 into the space between the anodic and the cathodic members 12 and 14, and the engagement between each of the nut members 80 and the first face 34 (the end walls 56) of the cathodic member 14 forms a seal for substantially inhibiting the flow of electrolyte through the openings 58 in the cathodic member 14 into the space between the anodic and the cathodic members 12 and 14. It should be noted that additional sealing material may be added to augment the mechanical seal formed via the engagement between portions of the fastener assemblies 16 and the cathodic and the anodic members 14 and 12 if required in a particular application.

The aligned channels 126 and 134 in the cell box 102 are sized and positioned to slidingly receive one of the hybrid bipolar electrodes 10 of the present invention (the hybrid bipolar electrode 10 sometimes referred to herein in connection with FIG. 5 as the first hybrid bipolar electrode 10), and the aligned channels 128 and 136 in the cell box 102 are sized and positioned to slidingly receive another hybrid bipolar electrode 10 constructed in accordance with the present invention (the hybrid bipolar electrode 10 sometimes referred to herein in connection with FIG. 5 as the last hybrid bipolar electrode 10). Each of the hybrid bipolar electrodes 10 is supported within the space 114 and extends between the side walls 104 and 106. The channels 124, 126, 128, 130, 132, 134, 136 and 138, are positioned to support the electrodes 10, 116 and 120 in a spaced apart relationship. The hybrid bipolar electrodes 10 are each oriented such that the anodic surface formed on the first face 20 of the anodic member 12 generally faces and is spaced a distance from the cathodic surface formed on either the monopolar cathodic electrode 120 or the next hybrid bipolar electrode 10 and the cathodic surface formed on the first face 34 of the cathodic member 14 generally faces and is spaced a distance from the anodic surface formed on either the monopolar anodic electrode 116 or the next hybrid bipolar electrode 10, the cathodic member 14 and the anodic member 12 of each hybrid bipolar electrode 10 being mechanically connected and in electrical series. For example, in an assembled position of the electrolytic cell 100, the anodic surface 144 formed on the monopolar anodic electrode 116 is spaced a distance 154 from the cathodic surface formed on the first face 34 of the first hybrid bipolar electrode 10 in a direction generally from the monopolar anodic electrode 116 toward the monopolar cathodic electrode 120; the anodic surface formed on the first face 20 of the first hybrid bipolar electrode 10 is spaced a distance from the cathodic surface formed on the first face 34 of the next hybrid bipolar electrode 10 (not shown in FIG. 5) in a direction generally from the monopolar anodic electrode 116 toward the monopolar cathodic electrode 120;and the anodic surface formed on the first face 20 of the last hybrid bipolar electrode 10 in the electrolytic cell 100 is spaced a distance 156 from the cathodic surface 150 formed on the monopolar cathodic electrode 120. During the operation of the electrolytic cell 100 of the present invention the current flows from the anodic surface 144 of the monopolar anodic electrode 116 through the electrolyte to the cathodic surface formed on the first face 34 of the first hybrid bipolar electrode 10; the current flows through the first hybrid bipolar electrode 10 from the cathodic member 14 to the anodic member 12 via the fastener assemblies 16; the current flows from the anodic surface formed on the first face 20 of the first hybrid bipolar electrode 10 through the electrolyte to the cathodic surface formed on the first face 34 of the next hybrid bipolar electrode 10 (not shown in FIG. 5); the current flows through the electrolyte to the cathodic surface formed on the first face 34 of the last hybrid bipolar electrode 10; the current flows through the last hybrid bipolar electrode 10 from the cathodic member 14 to the anodic member 12 via the fastener assemblies 16; and finally the current flows from the anodic surface formed on the first face 20 of the last hybrid bipolar electrode 10 through the electrolyte to the cathodic surface 156 formed on the monopolar cathodic electrode 120. It should be noted that the current flow to, through and from the hybrid bipolar electrodes 10 intermediate or disposed between the first and the last hybrid bipolar electrode 10 has not been referred to in detail in the foregoing description.

In summary, the cathodic surface on the cathodic member 14 is mechanically connected to the anodic surface on the anodic member 12 of each hybrid bipolar electrode, and the cathodic surface and the anodic surface of each hybrid bipolar electrode 10 are in electrical series. In addition, the anodic surface of each hybrid bipolar electrode 10 generally faces and is spaced a distance from a cathodic surface of either the monopolar cathodic electrode or one of the other hybrid bipolar electrodes 10, and the current flows from the anodic surface of each hybrid bipolar electrode 10, through the electrolyte, to the cathodic surface of either the monopolar cathodic electrode or one of the other hybrid electrodes 10. The cathodic surface of each hybrid bipolar electrode 10 generally faces and is spaced a distance from an anodic surface of either the monopolar anodic electrodes or one of the other hybrid bipolar electrodes 10 and the current flows from the cathodic surface to the anodic surface via the fastener assemblies of each hybrid bipolar electrode 10.

During the operation of the electrolytic cell 100, the electrolyte is introduced into the space 114 of the cell box 102 via the openings 122, and the electrolyte is removed from the space 114 of the cell box 102 by overflowing over the top (not shown) of the cell box 102 or, in some instances, by passing the electrolyte through openings (not shown) in the cell box 102 generally near the top thereof. In some applications, the cell box 102 is supported within a larger cell tank (not shown) and the electrolyte is retained within the cell tank circulated into the cell box 102 from the cell tank, removed from the cell box 102 and circulated back into the cell tank, a cooling coil being disposed in the cell tank in contact with the electrolyte for maintaining the electrolyte at a predetermined temperature level during the electrolysis operation. The construction and operation of cell boxes and cell tanks and the use of cell boxes in electrolytic applications is well known in the art, and a further detailed description is not required herein.

As mentioned before, the hybrid bipolar electrode 10 is particularly suitable for service in an alkali metal chlorate or chlorine electrolytic cell for the electrolysis of aqueous solutions of alkali metal chlorides, and, in this one preferred embodiment the anodic member 12 is constructed of a metal comprising or consisting essentially of titanium and an anodic surface is formed on the first face 20 of the anodic member 12 by coating the first face 20 with a precious metal or oxide thereof. Further, in this embodiment of the present invention, the cathodic member 14 is constructed of a metal comprising or consisting essentially of carbon steel, stainless steel or ferrous materials or non-ferrous materials serviceable in chlorate solutions, the first face 34 of the cathodic member 14 operating as the cathodic surface of the hybrid bipolar electrode. In an alkali metal chlorate or chlorine electrolytic cell application and utilizing an anodic member 12 and a cathodic member 14 constructed as just described above, the barrier member 18 is constructed of a material operating to shield or provide a hydrogen barrier for substantially inhibiting the migration of atomic hydrogen forming at the cathodic surface provided via the first face 34 of the cathodic member 14 during the operation of the electrolytic cell, the migration of atomic hydrogen occurring through the cathodic member 14 and tending to attack the titanium anodic member 12 and the barrier member 18 substantially preventing the atomic hydrogen from attacking the anodic member 12 and forming titanium hydrides. The formation of titanium hydrides on the titanium anodic member 12 caused warping and, in some applications, also caused disintegration of the anodic member 14, the formation of titanium hydrides also resulting in titanium hydride embrittlement. It has been proposed to clad the cathodic surface of a bipolar electrode constructed of titanium with steel to prevent the formation of titanium hydrides; however, it has been found that the thickness of the steel necessary to prevent the hydrogen from diffusing to the titanium was substantially large and, in many applications, prohibitive as far as an economically feasible or practical solution. In addition, it was required that the cladding edges be sealed from the anodic electrical potential, otherwise the steel would be substantially dissolved in the electrolyte. The hybrid electrode of the present invention provides a bipolar electrode wherein the anodic member can be constructed of a metal comprising titanium and yet substantially reducing the possibility of titanium hydrides attacking the titanium anodic member 12.

In one preferred embodiment, the barrier member 18 is constructed of an inert material such as a polyvinyl chloride (PVC or PVDC or CPVC or the like, for example) type of material, for example. In this embodiment, the barrier member 18 also operates to provide the hydrogen barrier substantially insulating the anodic member 12 from the cathodic member 14, except for the fastener assemblies 16 which are constructed of an electrically conductive material and establish electrical continuity between the anodic member 12 and the cathodic member 14, in a preferred embodiment. In this operational embodiment wherein the anodic member 12 is constructed of a metal consisting essentially of titanium, the cathodic member 14 is constructed of a metal providing a surface operating as a cathodic surface and the barrier member 18 is constructed essentially of an inert material; the bolt members 74 and the nut member 80 are each preferably constructed of an electrically conductive material such as copper or brass or the like, for example, the first spacer 82 is preferably constructed of a metal consisting essentially of titanium, and the second spacer 84 is constructed of a metal comprising carbon steel or a stainless steel or other ferrous or nonferrous materials or the like, for example.

It should also be noted that a plurality of depressions could be formed in the anodic member 12 to accommodate the head portions 76 of the bolt members 74 in a manner similar to that described before with respect to the depressions 46 in the cathodic member 14 and the nut members 80.

In the embodiment of the invention shown in FIGS. 1 through 4, the first spacers 82 operate to space the second face 22 of the anodic member 12 a distance from the first face 60 of the barrier member 18, and the second spacers 84 operate to space the second face 36 of the cathodic member 14 and the ends 54 portion of the second face 36 of the cathodic member 14 a distance from the second face 62 of the barrier member 18. The first and second spacers 82 and 84 cooperate with the barrier member 18 to space the second face 22 of the anodic member 12 the distance 92 from the second face 36 of the cathodic member 14. Thus, the elements of the hybrid bipolar electrode 10 which are constructed of a metal comprising titanium are isolated and spaced from the cathodic member 14 i.e. the hydrogen producing member or elements as in the case of the second spacer 84. The spacing of the elements constructed of a metal comprising titanium from the hydrogen producing elements (the cathodic member 14) and the disposition and construction of the barrier member 14 cooperate to substantially reduce the possibility of hydrogen attacking the elements constructed of titanium and provide a metal bipolar electrode having an anodic member constructed of titanium which is serviceable in an alkali metal chlorate or chlorine electrolytic cell application.

EMBODIMENT OF FIG. 6

Figure 6:
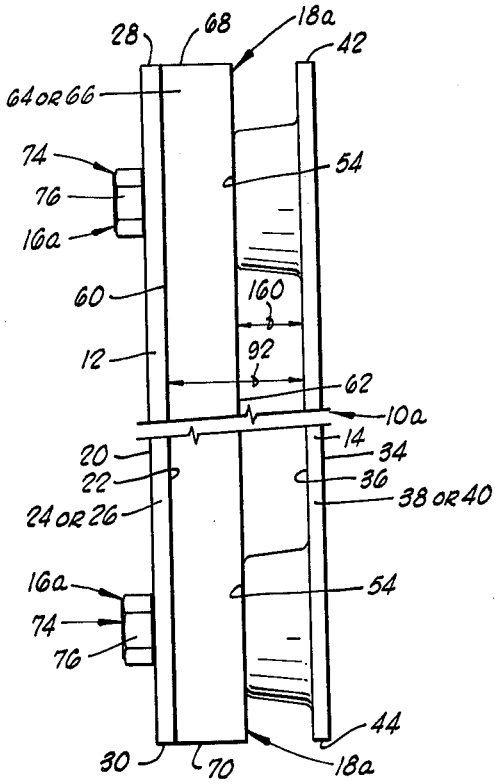
FIG. 6 is a fragmentary view similar to FIG. 3, but showing a typical first or second side elevational view of a modified hybrid bipolar electrode.

Shown in FIG. 6 is a modified hybrid bipolar electrode **10*a* which is constructed exactly like the hybrid bipolar electrode 10, except the hybrid bipolar electrode 10*a* includes a modified barrier member 18*a* and the fastener assemblies 16*a* do not include spacers similar to the spacers 82 and 84 of the hybrid bipolar electrode 10. Thus, the first face 60 of the barrier member 18*a* generally abuts the second face 22 of the anodic member 12 and the second face 62 of the barrier member 18*a* is disposed near and generally abuts the second face 36 of the cathodic member 14, the second face 62 of the barrier member 18*a*, more particularly, abutting ends 54 portions of the second face 36 of the cathodic member 14 and the second face 62 of the barrier member 18*a* being spaced a distance 160 from the second face 36 of the cathodic member 14 via the raised portions formed by the depressions 46 (not shown in FIG. 6) and the corresponding raised portions on the cathodic member 14. It should be noted that, in this embodiment of the invention, the second face 62 of the barrier member 18*a* can abut the second face 36 of the cathodic member 14 if the depressions 46** are eliminated.

In this embodiment of the invention, the barrier member **18*a* is constructed of a material comprising graphite, in one preferred form, and the barrier member 18*a*, more particularly, is constructed of an oil impregnated type of graphite. The barrier member 18*a* operates to provide a hydrogen barrier substantially inhibiting the migration of atomic hydrogen to the anodic member 12 and the resulting formation of titanium hydrides in a manner like that described before with respect to the barrier member 18. However, in this embodiment of the invention, the barrier member 18*a* is also constructed of an electrically conductive material (graphite or oil impregnated graphite, for example), and the barrier member 18*a* cooperates with the spacing pattern of the fastener assemblies 16 to enhance the establishment of a substantially uniform current density on the anodic member 12 and the cathodic member 14**.

The hybrid bipolar electrode **10*a* provides a particularly useful construction for converting the bipolar electrodes of existing electrolytic cells to the type of bipolar electrode construction of the present invention. For example, some existing alkali metal chlorate or chlorine electrolytic cells presently utilize bipolar electrodes constructed essentially of graphite and each of these existing graphite electrodes can be utilized to form the barrier member 18*a*. It should be noted that, in some instances, it may be desirable to reduce the thickness of the existing graphite electrodes to form the barrier member 18***a*. For example, some typical existing graphite electrodes have a thickness of approximately 1.1 inches and the thickness of the barrier member 18*a* of the replacing hybrid bipolar electrode 10*a* would be approximately ½ inches, assuming the replacing hybrid bipolar electrode 10*a* is intended to be utilized under approximately equivalent operating conditions as the replaced existing graphite electrodes.

The hybrid bipolar electrode 10*a* is assembled in a manner similar to that described before with respect to the hybrid bipolar electrode 10 except the assembly steps do not include provisions for installing the spacers 82 and 84 since the necessity of providing the spacers 82 and 84 is eliminated via the construction of the hybrid bipolar electrode 10*a*. The hybrid bipolar electrode 10*a* is sealed via the seal member 152 in a manner like that described before with respect to the seal member 152 and the hybrid bipolar electrode 10, and the hybrid bipolar electrode 10*a* is installed and operates in an electrolytic cell in a manner like that described before with respect to the electrolytic cell 100 and the hybrid bipolar electrodes 10. The hybrid bipolar electrode 10*a* is shown in FIG. 5 assembled in the electrolytic cell 100; however, it should be noted that the barrier member 18*a* is shown in FIG. 5 spaced a slight distance from the anodic member 12 and the cathodic member 14 merely for the purpose of diagrammatically illustrating the various aspects of the present invention and it is not required to space the barrier member 18*a* from the anodic member 12 or the cathodic member 14 in this last described embodiment of the invention.

Changes may be made in the construction and the arrangement of the various parts or the elements of the embodiments disclosed herein or in the steps of the method disclosed herein without departing from the spirit and the scope of the invention as defined in the following claims.

What is claimed is:

1. A hybrid bipolar electrode, for use in an electrolytic cell wherein the bipolar electrode is at least partially immersed in an electrolyte, said bipolar electrode comprising:

an anodic member having a first face and a second face;

a cathodic member having a first face and a second face;

means for supporting the anodic member and the cathodic member in a spaced apart relationship with the second face of the anodic member being spaced a distance from the second face of the cathodic member;

means engaging portions of the anodic member and the cathodic member for substantially sealing electrolyte from a substantial portion of the space between the anodic and the cathodic members; and means having a portion constructed of an electrically conductive material and portions contacting the anodic member and the cathodic member, said means electrically connecting the anodic member and the cathodic member in series.

2. The hybrid bipolar electrode of claim 1 defined further to include:

a barrier member disposed in the space between the anodic member and the cathodic member, the barrier member shielding the anodic member from the cathodic member.

3. The hybrid bipolar electrode of claim 2 defined further to include:

at least one first spacer, each first spacer being disposed between the anodic member and the barrier member and spacing the anodic member a distance from the barrier member.

4. The hybrid bipolar electrode of claim 3 defined further to include:

at least one second spacer, each second spacer being disposed between the cathodic member and the barrier member and spacing the cathodic member a distance from the barrier member.

5. The hybrid bipolar electrode of claim 3 wherein the anodic member is constructed of a material comprising titanium and the barrier member is constructed of an inert material, the barrier member inhibiting the migration of hydrogen from the cathodic member to the anodic member.

6. The hybrid bipolar electrode of 2 wherein the anodic member is constructed of a material comprising titanium and the barrier member is constructed of a material selected from a group consisting of graphite and polyvinyl chloride.

7. The hybrid bipolar electrode of claim 6 wherein the barrier member includes a first face and a second face, the first face of the barrier member abutting a portion of the second face of the anodic member and the second face of the barrier member abutting a portion of the second face of the cathodic member; and wherein the means supporting the anodic member and the cathodic member in a spaced apart relationship is defined further as supporting the barrier member between the second face of the anodic member and the second face of the cathodic member, the second face of the anodic member being spaced a distance from the second face of the cathodic member.

8. The hybrid bipolar electrode of claim 2 wherein the anodic member includes at least one opening, each opening being formed through the anodic member intersecting the first and the second faces of the anodic member; and wherein the cathodic member includes at least one opening, each opening being formed through the cathodic member intersecting the first and the second faces of the cathodic member, each opening in the cathodic member being aligned with an opening in the anodic member; and wherein the means supporting the anodic member and the cathodic member in a spaced apart relationship is defined further to include:

at least one fastener assembly, each fastener assembly having a portion extending through one of the openings in the anodic member and through one of the openings in the cathodic member, and each fastener assembly having a portion engaging the anodic member and a portion engaging the cathodic member, the fastener assemblies mechanically connecting the anodic member and the cathodic member in a spaced apart relationship.

9. The hybrid bipolar electrode of claim 8 wherein the barrier member includes at least one opening, each opening extending through the barrier member, and each opening in the barrier member being aligned with one of the openings in the anodic member and with one of the openings in the cathodic member; and wherein each fastener assembly is defined further to include a portion extending through one of the openings in the barrier member, the fastener assemblies supporting the barrier member in the space between the anodic member and the cathodic member.

10. The hybrid bipolar electrode of claim 2 wherein the means supporting the anodic member and the cathodic member in a spaced apart relationship is defined further to include:

at least one fastener assembly each fastener assembly having a portion engaging the anodic member, a portion engaging the barrier member and a portion engaging the cathodic member, the fastener assemblies mechanically connecting the anodic member and the cathodic member in the spaced apart relationship and supporting the barrier member in the space between the anodic member and the cathodic member.

11. The bipolar electrode of claim 1 wherein the means supporting the anodic member and the cathodic member in a spaced apart relationship is defined further to include a plurality of fastener assemblies, each fastener assembly having a portion connected to the anodic member and a portion connected to the cathodic member, each fastener assembly mechanically connecting and establishing electrical continuity between the anodic member and the cathodic member.

12. The hybrid bipolar electrode of claim 1 wherein the anodic member is defined further to include a coating on the first face thereof operating as an anodic surface in an electrolysis application, the second face of the anodic member being spaced a distance from the second face of the cathodic member and the first face of the cathodic member operating as a cathodic surface in an electrolysis application.

13. An improved electrolytic cell having electrodes connected to an electrical power source and at least partially immersed in an electrolyte wherein the electrolytic cell includes at least one bipolar electrode including an anodic member having a first face and a second face and a cathodic member having a first face and a second face, the improvement comprising:

at least one fastener assembly, each fastener assembly having a portion connected to the anodic member and a portion connected to the cathodic member of each bipolar electrode in the electrolytic cell, each fastener assembly mechanically connecting the anodic member and the cathodic member in a spaced apart relationship with the second face of the anodic member spaced a distance from the second face of the cathodic member;

means engaging portions of the anodic member and the cathodic member for substantially sealing electrolyte from a substantial portion of the space between the anodic and the cathodic members; and means having a portion constructed of an electrically conductive material and portions contacting the anodic member and the cathodic member, said means electrically connecting the anodic member and the cathodic member in series.

14. The electrolytic cell of claim 13 wherein the improvement is defined further to include:

a barrier member disposed in the space between the anodic member and the cathodic member, the barrier member shielding the anodic member from the cathodic member.

* * * * *